United States Patent [19]

Kümmel et al.

[11] 4,412,757

[45] Nov. 1, 1983

[54] VIBRATION MACHINE FOR COMPACTING MATERIALS, IN PARTICULAR AN EARTH COMPACTING MACHINE

[75] Inventors: Friedrich Kümmel, Esslingen-Sulzgries; Rudolf Hennecke, Remshalden-Buoch; Manfred Schubert, Kirchheim; Ludwig Unrath, Esslinger-Neckarhalde, all of Fed. Rep. of Germany

[73] Assignees: Delmag-Maschinenfabrik Reinhold Dornfeld GmbH & Co., Esslingen, Fed. Rep. of Germany

[21] Appl. No.: 297,123

[22] Filed: Aug. 28, 1981

[30] Foreign Application Priority Data

Sep. 5, 1980 [DE] Fed. Rep. of Germany ..... 3033476

[51] Int. Cl.[3] ..... E01C 19/38

[52] U.S. Cl. ..... 404/113; 404/117; 74/61; 74/87; 366/108

[58] Field of Search ..... 404/113, 117; 366/108, 366/116

[56] References Cited

U.S. PATENT DOCUMENTS

| | | | |
|---|---|---|---|
| 3,274,907 | 9/1966 | Haage | 404/113 |
| 3,385,119 | 5/1968 | Berger | 404/113 X |
| 3,598,029 | 8/1971 | Paramythioti | 404/117 |
| 3,618,485 | 11/1971 | Hermann | 404/117 |
| 3,878,733 | 4/1975 | Tertinek | 404/113 X |
| 4,145,156 | 3/1979 | Grane | 404/113 |
| 4,176,983 | 12/1979 | Gardner | 404/113 X |
| 4,199,271 | 4/1980 | Riedl | 404/113 X |

FOREIGN PATENT DOCUMENTS

| | | | |
|---|---|---|---|
| 1023172 | 3/1966 | United Kingdom | 404/113 |

*Primary Examiner*—Nile C. Byers, Jr.

*Attorney, Agent, or Firm*—Shenier & O'Connor

[57] ABSTRACT

A material compacting vibration machine provided with an imbalanced system having coaxial first and second independently rotatable shafts carrying first and second drive elements and a pair of unbalanced masses having third and fourth drive elements secured thereto with driving connections between the first and third drive elements and between the second and fourth drive elements, and a drive shaft selectively coupled to the first and second drive elements, wherein the four drive elements all are disposed on one side of the imbalanced system and are shielded by a cover.

10 Claims, 10 Drawing Figures

Figure 2:
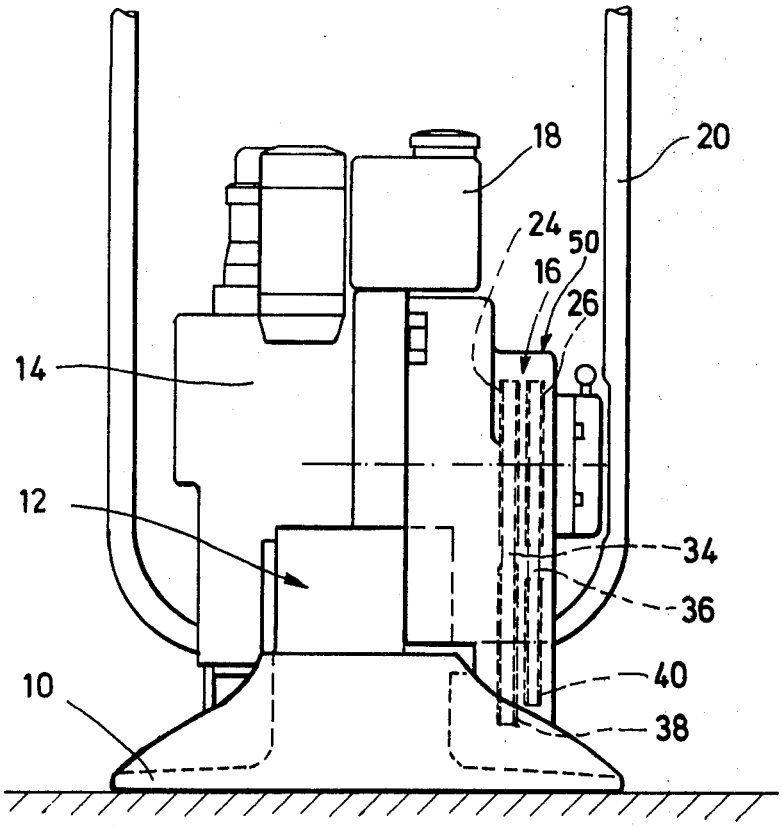

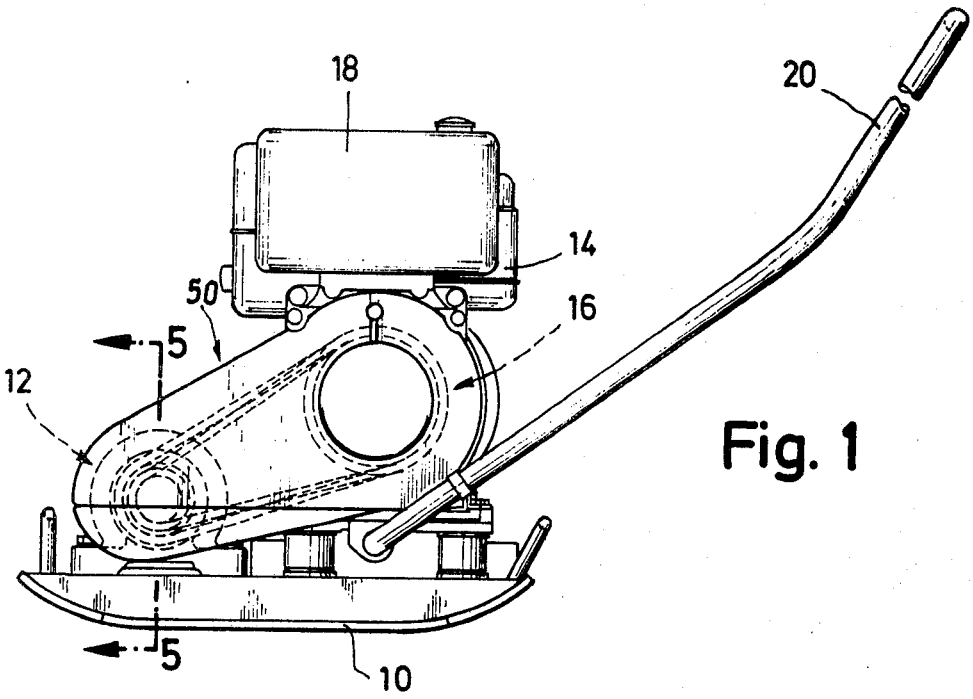
Fig. 1
Fig. 3
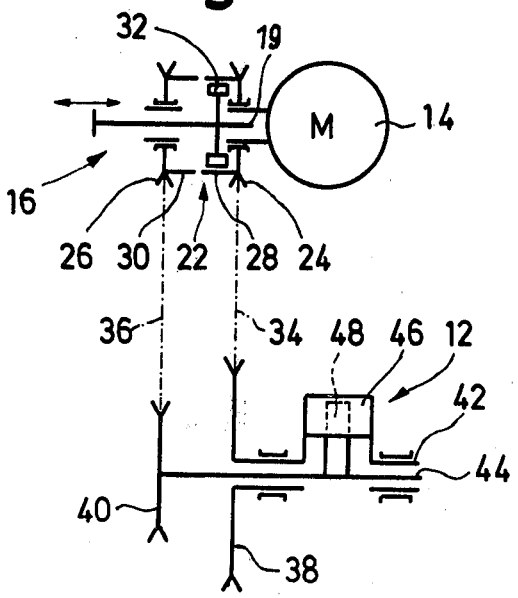
Fig. 4a
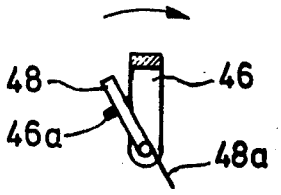
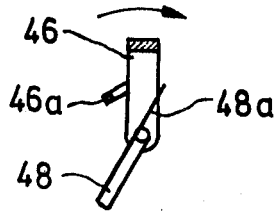
Fig. 4b

VIBRATION MACHINE FOR COMPACTING MATERIALS, IN PARTICULAR AN EARTH COMPACTING MACHINE

The invention relates to a vibration machine for compacting materials, in particular an earth compacting machine, having an imbalance system with two coaxial shafts drivable independently of each other, each of these shafts being connected with an unbalanced mass and a first or second gear element, also having a drive shaft and at least one actuatable clutch for selective driving of a third or fourth gear element, each of these elements being in drive connection with the first or second gear element. These gear elements will normally be drive pulleys, pinions or the like so that the drive connection is established via a V belt or toothed belt, via direct meshing of the pinions with each other or via intermediate gear wheels.

In the case of a known vibration machine of this type (German Offenlegungsschrift No. 1 558 869) one of the two coaxial shafts is designed as a hollow shaft and bears an unbalanced mass in the shape of a half shell, which covers the second unbalanced mass seated on a core shaft so that the two shafts together with the relevant unbalanced masses may be driven independently of each other. This is accomplished by a drive shaft running parallel to the two coaxial shafts, which drives an actuatable clutch, with which two drive pulleys may be selectively connected, these pulleys being rotatably mounted on opposite ends of the drive shaft. These drive pulleys each drive one of the unbalanced masses via V belts and drive pulleys secured to the opposite ends of the two coaxial shafts. As the transmission ratio of the two drive pulley gearings were, like the imbalances of the two unbalanced masses, selected to be different the known vibration machine can be driven not only at two different frequencies but also with two different imbalances whereby a strong association exists between frequency and imbalance.

The known vibration machine has various disadvantages: In order for operating personnel not to be endangered the operating personnel must be prevented from being able to reach into or their articles of clothing being caught in the drive pulley gearings mentioned; for this reason two casing-like covers are necessary on both sides of the imbalance system of the known vibration machine. In addition, one of the two unbalanced masses is ineffective during every mode of operation so that it merely increases the weight of the vibration machine.

On the basis of the present invention a vibration machine of the type described at the beginning is created, which is simpler in its construction and can be more compactly built than the known vibration machine described due to the fact that, according to the invention, the four gear elements serving to drive the two unbalanced masses are all disposed on one side of the imbalance system and shielded by a cover. The vibration machine according to the invention therefore has a gear unit only on one side of the imbalance system so that a cover is also required only on one side of the imbalance system. Therefore, the new vibration machine may not only be produced more cheaply but also be constructed smaller and with less weight.

In the case of vibration earth compacting machines it is in fact known (German Auslegeschrift No. 21 08 106) to dispose on a drive shaft on only one side of an imbalance system two gear elements in the form of drive pulleys as well as an actuatable clutch, with the aid of which one of the two drive pulleys can be selectively connected with the drive shaft. However, even with this known construction gear elements are disposed on both sides of the imbalance system havin only one single unbalanced mass and therefore only one single shaft. These gear elements consist of two drive pulleys secured on the ends of the shaft of the unbalanced mass, which are turned away from each other, and two drive pulleys also mounted on the ends of the intermediate shaft, which are turned away from each other. This intermediate shaft extends over the entire width of the imbalance system and serves to drive the unbalanced mass in the opposite direction to the normal direction of rotation. With this known vibration machine the actuatable clutch does not, therefore, serve to alter the frequency, with which the unbalanced mass is driven, but to reverse the direction of rotation. The vibration machine according to German Auslegeschrift No. 21 08 106 therefore has all the disadvantages of the vibration machine according to German Offenlegungsschrift No. 1 558 869 and its imbalance system has no truly one-sided drive.

In the case of vibration machines having an imbalance system with two unbalanced masses it is also known (German Offenlegungsschrift No. 27 38 794) to set different total imbalances in that the unbalanced masses may be disposed and fixed in different angular positions relating to each other by means of a coupling.

In order to achieve the same effect without complicated constructional parts like couplings being, however, necessary it is now suggested according to the invention that the imbalance system be designed such that, at least in one angular position of the two unbalanced masses relative to each other, the unbalanced mass not coupled to the drive shaft will be taken along by the other unbalanced mass and that, for the angular position in which the unbalanced masses have the smaller angular distance between them, a stop taking along the second unbalanced mass rotates together with the first, driven unbalanced mass, this stop being disposed such that the first unbalanced mass is ahead of the second unbalanced mass. In this connection the following must be pointed out: It would not be adequate simply to have a stop for the unbalanced mass not being driven running along with the unbalanced mass being driven; if, in the state of greatest total imbalance, i.e. unbalanced masses rotating with each other essentially without any angular distance between them, the larger unbalanced mass were to be coupled with the drive and the smaller unbalanced mass taken along by a stop rotating with the larger unbalanced mass such that it is positioned, in the direction of rotation, in front of the large unbalanced mass taking it along, which would be the most obvious way, this would result in the unbalanced mass taken along immediately assuming an angular position, in which it is approximately facing the driven unbalanced mass—such an imbalance system always endeavours to assume the state of least total imbalance. When such a vibration machine strikes the ground the smaller unbalanced mass taken along would be able to run ahead of the larger unbalanced mass coupled to the drive. For this reason the construction according to the invention provides for the driven unbalanced mass to be always ahead of the unbalanced mass taken along. In this case the imbalance system cannot, when the total imbalance is continuously reduced, change over to a state of least total imbalance since a stage must first of all be passed, in which the total imbalance is larger than in the circumstance, in which the two unbalanced masses have a smaller angula distance between them and the driven unbalanced mass is ahead of the unbalanced mass taken along.

The vibration machine according to the invention makes it possible, with the simplest construction, to drive an imbalance system with a large effective total imbalance during operation at low frequency and with a small effective total imbalance at high frequency. This is a big advantage for earth compacting machines since it is better to work hard ground at high frequency and low amplitude in order to avoid damaging the vibration machine whereas for soft ground, like loam, large jumps of the vibration machine are desired at low frequency in order to prevent the vibration machine sticking to the soft, moist ground.

For the state of smallest total imbalance a stop to take along the unbalanced mass not driven would not actually be necessary since the imbalance system endeavours in any case to assume this state when one of the two unbalanced masses is driven and the other can freely rotate However, so that the state of the smallest total imbalance is quickly assumed when the shaft of the imbalance system, which is associated with the state of smallest total imbalance, is driven a preferred embodiment of the vibration machine according to the invention has, for the angular position in which the unbalanced masses have the greater angular distance between them, a stop taking the first unbalanced mass along.

Finally, a particularly simple construction is suggested for the clutch of the vibration machine; according to this proposal the clutch is intended to have a clutch cylinder for connecting each of the two gear elements to the drive shaft, these clutch cylinders being disposed next to each other in axial direction and having only one single, actuatable flyweight clutch element associated with them, this being secured to the drive shaft such that they cannot rotate relative to each other, and for changing the clutch clutch element and clutch cylinders are displaceable relative to each other in axial direction such that the clutch element can be selectively disposed inside one of the clutch cylinders associated with it. In contrast to the known actuatable flyweight clutches (e.g. German Offenlegungsschrift No. 25 09 322) such a flyweight clutch element can thus be dispensed with.

A particularly space-saving clutch results when the clutch cylinders are each secured to one of the gear elements to be coupled with the drive shaft such that they cannot rotate relative to each other, are disposed between these elements in axial direction and rotatably mounted together with these elements on the drive shaft.

In one advantageous embodiment of the clutch according to the invention an actuating element penetrating the drive shaft in axial direction is provided for the flyweight clutch element displaceable along the drive shaft so that the clutch elements may be designed to be axially immovable. One embodiment is, however, constructed shorter in overall length in axial direction. With this embodiment the clutch cylinders are not rotatable relative to the gear element associated with each cylinder, are however displaceable in axial direction and may therefore be disposed alternatively over the flyweight clutch element. The feed path of this embodiment lies between the two gear elements to be coupled with the drive shaft so that the embodiment is shorter in axial direction than the first embodiment described by the length of the feed path, the first embodiment described requiring as much space on the far side of a gear element as corresponds to the movement of the actuating element along the length of the feed path.

In the case of the second embodiment described above it is finally advisable to mount an actuating element rotatably on the clutch cylinders, with which it is rigidly connected in axial direction, in order to be able to move the clutch cylinders back and forth with a stationary actuating element.

A particular advantage of the flyweight clutch according to the invention is that it can be manufactured from the standard parts of known flyweight clutches available on the market and therefore cheaply.

Figure 5:
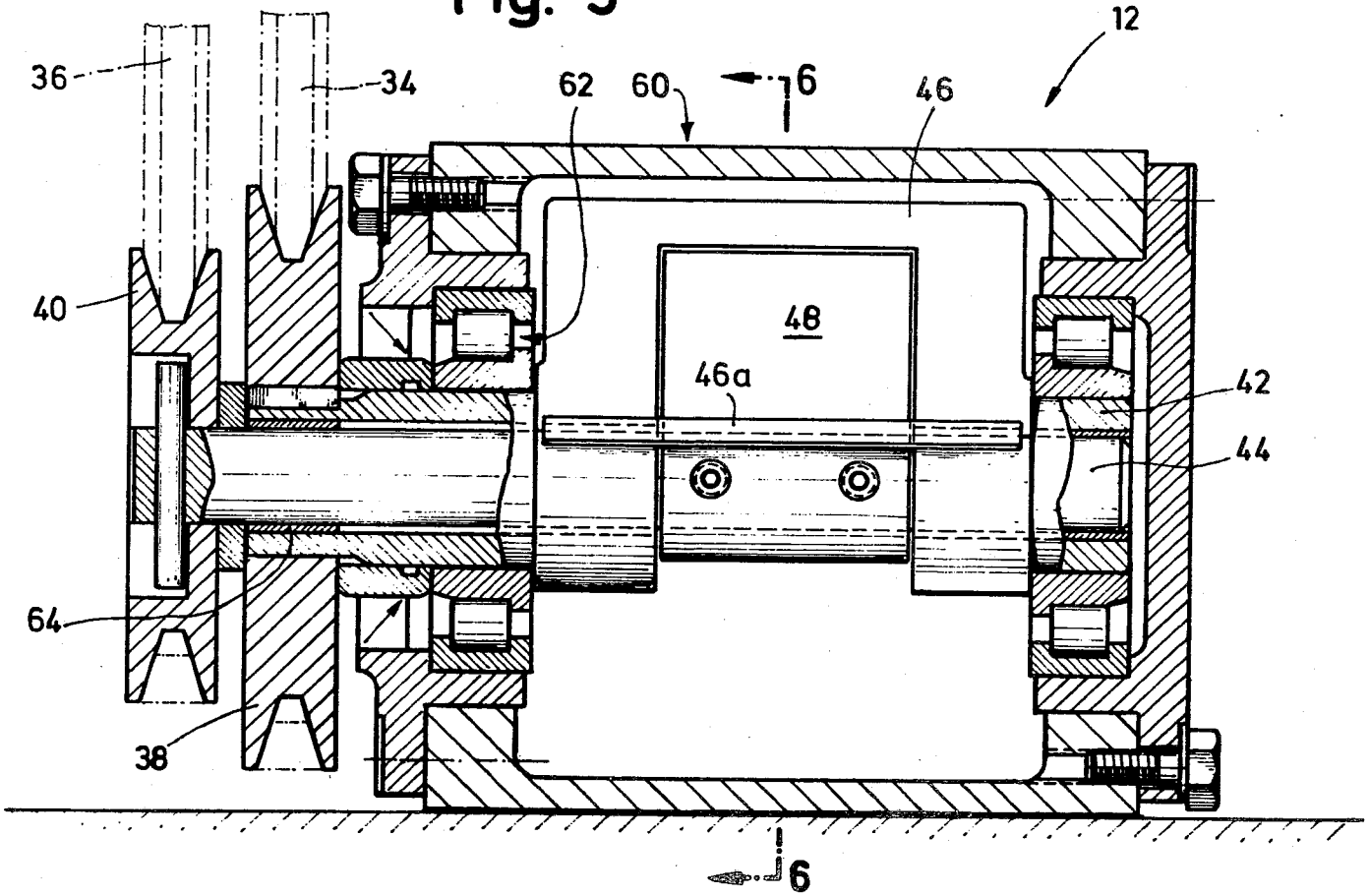
Figure 6:
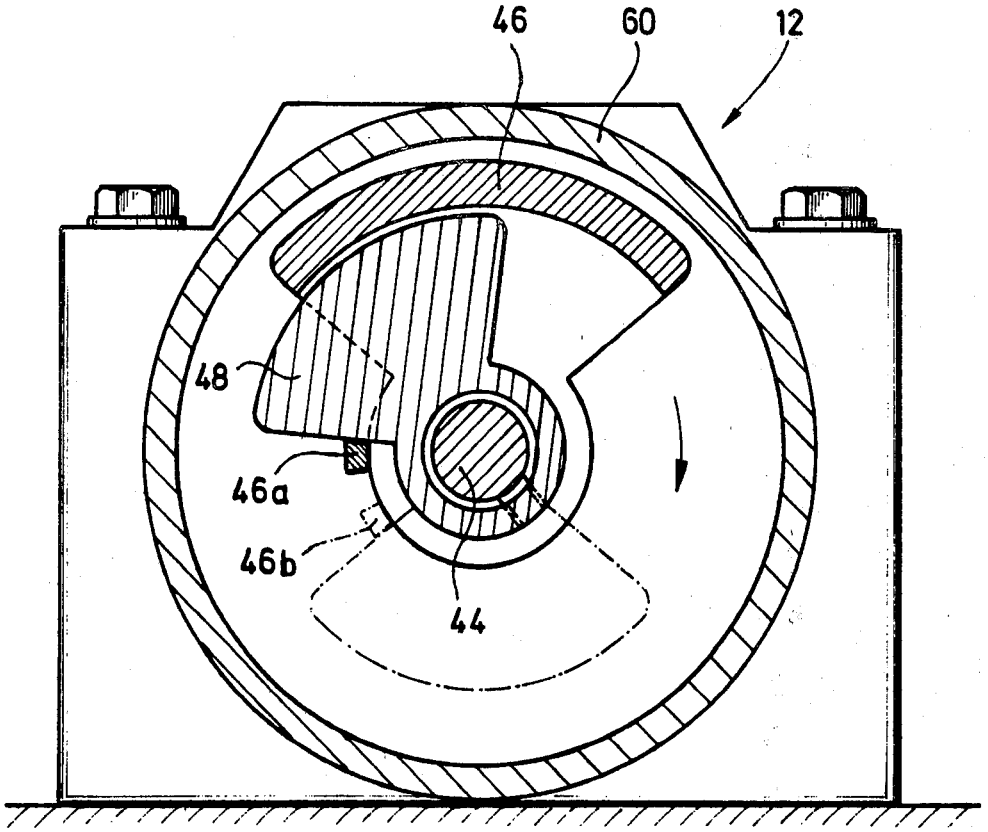
Figure 8:
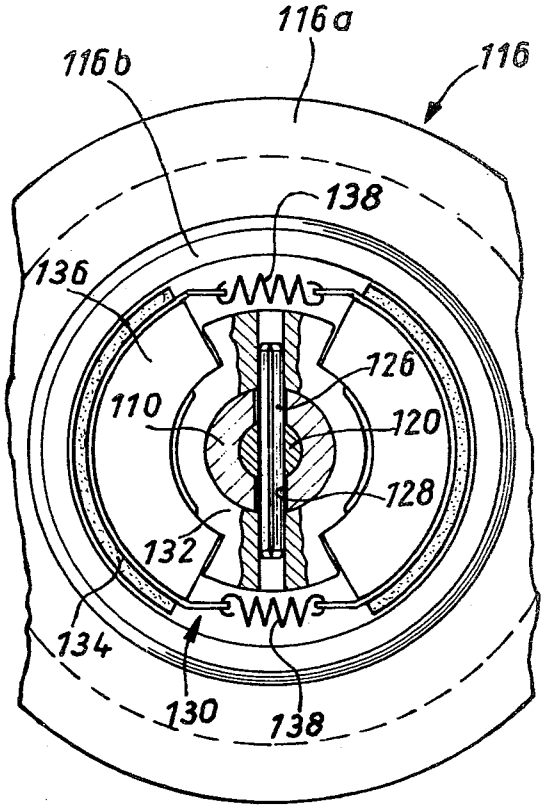
Figure 7:
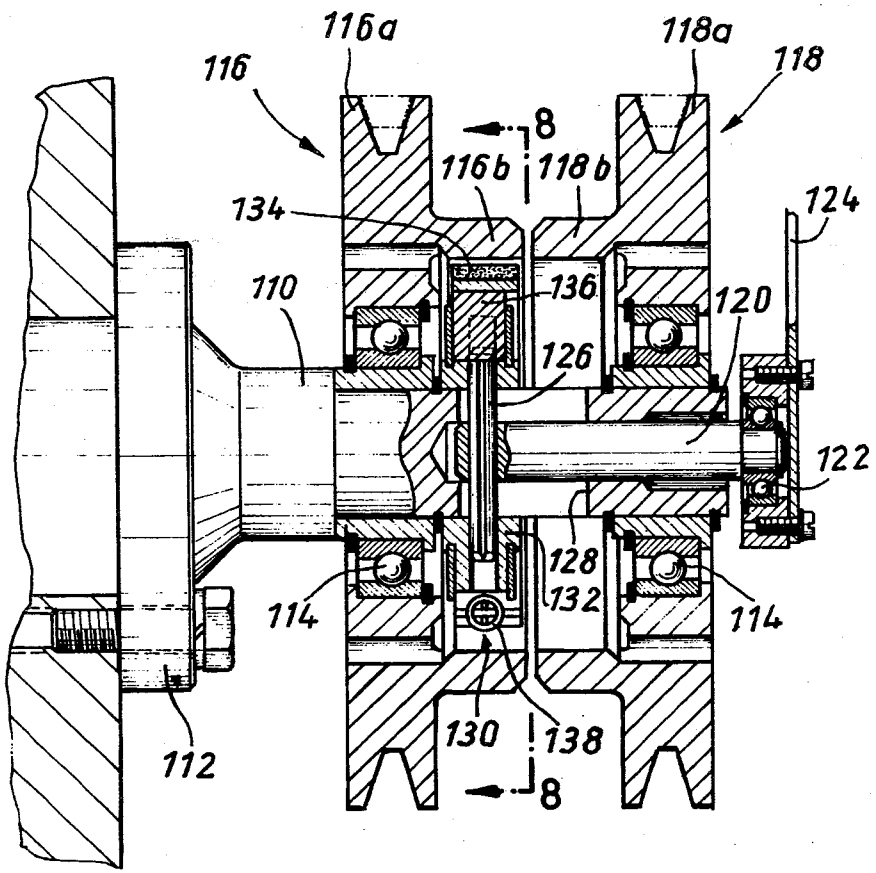
Figure 9:
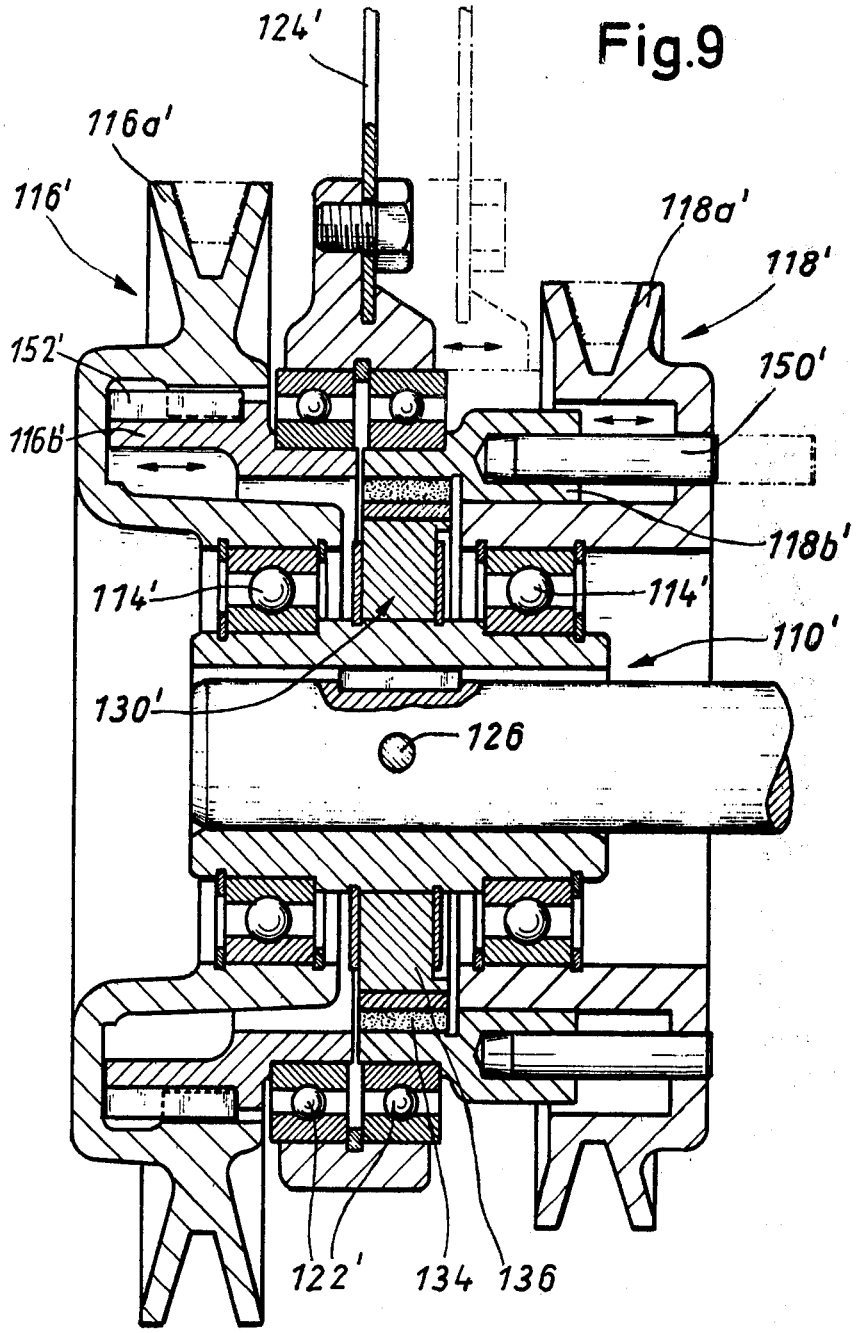

Additional features, advantages and details of the invention are shown in the attached claims and/or in the attached drawings and the following specification of preferred embodiments of a vibration machine according to the invention, of an imbalance system according to the invention and a flyweight clutch according to the invention; the attached drawings show:

FIG. 1: a side view of the vibration machine designed as an earth impacting machine;

FIG. 2: a front view of this earth impacting machine;

FIG. 3: a diagrammatic representation of the imbalance system and its drive as used in the earth compacting machine according to FIGS. 1 and 2;

FIG. 4*a*, FIG. 4*b*: the states of greatest and smallest total imbalance of the imbalance system in a diagrammatic side view;

FIG. 5: an axial section through the imbalance system along line 5—5 in FIG. 1;

FIG. 6: a cross section through the imbalance system along line 6—6 in FIG. 5;

FIG. 7: an axial section through a first embodiment of a flyweight clutch according to the invention;

FIG. 8: a section along line 8—8 in FIG. 7 whereby only the flyweight clutch element is illustrated, and FIG. 9: an axial section through a second embodiment of the flyweight clutch according to the invention.

FIGS. 1 and 2 show an earth compacting machine designed according to the invention comprising a vibrating plate 10, to which an imbalance system 12 is secured. This is driven by an internal combustion engine 14 via a drive system 16. A tank located in front of the engine is designated 18, a handle for the machine, attached to the vibrating plate 10, is designated 20.

As FIG. 3 shows the engine selectively drives one of two drive pulleys 24, 26 via a drive shaft 19 and a flyweight clutch 22. For this purpose a clutch cylinder 28 or 30 is connected with each of the drive pulleys; an axially displaceable drive element 32 is disposed inside each cylinder, the drive element being secured to the drive shaft 19 such that they cannot rotate relative to each other. The drive element will, when the engine speed is increased, make friction contact like flyweights with the clutch cylinder 28 or 30, in which it is disposed at the time. By shifting the gear element 32 the clutch cylinder and thereby the drive pulley 24 or 26 which are to be driven can be preselected.

These drive pulleys are connected via V belts 34 or 36 to drive pulley 38 and 40, of which the first is secured to hollow shaft 42 such that they cannot rotate relative to each other and the second in the same way to a core shaft 44 concentric to the hollow shaft.

The hollow shaft 42 bears a larger, the core shaft 44 a smaller unbalanced mass 46 or 48 so that the two shafts and the two unbalanced masses together form the imbalance system designated 12 in FIGS. 1 and 2.

As one of the two clutch cylinders 28, 30 can always rotate freely the unbalanced mass 46 or 48 connected to the shaft 42 or 44 not being driven could in fact assume any angle of rotation compared with the driven unbalanced mass. However, stops are provided which are disposed according to the invention such that when the large unbalanced mass 46 is driven the small unbalanced mass 48 is not taken along merely in any position but in a position, in which it lags slightly behind the large unbalanced mass 46, as illustrated in FIG. 4*a*. On the other hand, a stop taking along the large unbalanced mass 46 is also provided for the state of smallest effective total imbalance, at which the small unbalanced mass 48 will be driven, in order to succeed in having the larger unbalanced mass 46 taken along from the beginning in the position, in which it is almost diametrically opposite to the smaller unbalanced mass 48, as illustrated in FIG. 4*b*.

If the diameter of the drive pulleys 24, 26, 38, 40 is selected accordingly it is possible for the unbalanced masses 46 and 48 to be driven at differing rotational speeds and for the machine to run at a low frequency with large imbalance and at a high frequency with small imbalance.

As the entire gearing 24, 26, 38, 40, 34, 36 is located according to the invention on one side of the imbalance system 12 only one casing-like cover is required, this being designated 50 in FIGS. 1 and 2.

FIGS. 5 and 6 show a preferred embodiment of the imbalance system 12 according to the invention, with which the hollow shaft 42 is mounted in a housing 60 with the aid of roller bearings 62 whereas the core shaft 44 is mounted with the aid of sliding bearings 64.

According to the invention a stop bar 46*a* is attached to the large unbalanced mass 46 such that when the hollow shaft 42 or the large unbalanced mass 46 are driven the small unbalanced mass 48 taken along will lag behind slightly in the direction of rotation, as illustrated in FIG. 6 by the solid lines.

In addition, a further stop bar 46*b* may be provided on one of the unbalanced masses, in the case of the illustrated embodiment on the large unbalanced mass 46. When the core shaft is driven this stop bar takes along the large unbalanced mass such that the large unbalanced mass is diametrically opposite the small unbalanced mass 48. This state is ullustrated in FIG. 6 by the dash-dot lines.

In the case of the vibration machine according to the invention the two conditions of largest and smallest total imbalance are therefore brought about by the simplest means so that complicated parts such as actuatable clutches in the imbalance system itself may be dispensed with.

FIG. 7 shows a drive shaft 110 with a driving flange 112; two drive pulley members 116 and 118 with axially immovable ball bearings 114 are rotatably mounted on the drive shaft 110 but are immovable in axial direction. Each of these drive pulley members forms a drive pulley 116*a* or 118*a* and a clutch cylinder 116*b* or 118*b*, whereby the latter face each other and, according to the invention, have the same inner diameter.

An actuating axis 120 is displaceable lengthwise in the drive shaft 110; it has an actuating lever 124 on its outer end over a ball bearing 122 held immovably in axial direction while a tension pin 126 is mounted on its inner end, this reaching through elongated slots 128 in the drive shaft 110 on both sides of the actuating axis 120 and projecting into a clutch disc designated as a whole as 130. This clutch disc is available on the market as a complete part, e.g. from Robert Scheuffele & Co., D 7120 Bietigheim-Bissingen.

The clutch disc 130 has a disc member 132, on which flyweights 136 provided with clutch facings 134 are held, with the aid of springs 138 pulling the flyweights towards each other, such that they may move relative to the disc member 132 only outwards in radial direction.

By shifting the actuating lever 124 in axial direction the clutch disc 130, which is secured via the tension pin 126 to the drive shaft 110 such that they cannot rotate relative to each other, may be displaced in axial direction when the drive shaft 110 is stationary or rotating only at idling speed and can thus be selectively disposed inside one of the clutch cylinders 116*b* and 118*b* so that one of the two drive pulleys 116*a* and 118*a* may be selectively driven when the rotational speed of the drive shaft 110 is increased.

In the case of the variation of the flyweight clutch according to the invention, as shown in FIG. 9, a clutch disc 130′ is rigidly attached to the drive shaft 110′, i.e. it rotates with and is immovable relative to the drive shaft. With the aid of ball bearings 114′ held immovably on the drive shaft 110′ two drive pulley members 116′ and 118′ are rotatably mounted on the drive shaft but are not displaceable relative to the drive shaft and they each form a drive pulley 116*a*′ or 118*a*′.

In the case of this embodiment the clutch cylinders 116*b*′ and 118*b*′ are not molded onto the drive pulley members but constructed as separate parts, which are secured via a circle of coupling pins 150′ or engaging wedges 152′ with the associated drive pulley member such that they cannot rotate relative to each other, may however be displaced in axial direction relative to the drive pulley member.

A ball bearing 122′ is attached to each of the clutch cylinders 116*b*′ or 118*b*′; an actuating lever 124′ has been attached to the outer races of these ball bearings so that one of the two clutch cylinders 116*b*′ or 118*b*′ may be selectively shifted over the clutch disc 130′ with the aid of the actuating lever.

For the parts of the embodiment according to FIG. 9 not described above the same reference numerals were used for FIGS. 7 and 8 but increased by 100.

Since, in the case of the second embodiment, the space required by the two clutch cylinders in axial direction between the two drive pulleys is used to house the feed path the embodiment according to FIG. 9 is smaller in construction in axial direction than the embodiment according to FIG. 7.

The invention having thus been described, what is claimed is:

1. A vibration machine for compacting materials such as earth comprising an imbalance system having first and second coaxial shafts, means mounting said shafts for independent rotary movement, a pair of unbalanced masses, first and second drive elements carried respectively by said shafts for rotation therewith, third and fourth drive elements secured respectively to said masses for rotation therewith, respective driving connections between said first and third drive elements and between said second and fourth drive elements, a drive shaft and clutch means for selectively coupling said drive shaft to said first and second drive elements, characterized in that the four drive elements (24, 26, 28, 40)

are all disposed on one side of the imbalance system (12) and shielded by a cover (50).

2. A vibration machine according to claim 1, characterized in that the unbalanced masses (46, 48) are adjacent to each other in axial direction and are disposable in at least two angular positions relative to each other in accordance with the direction of drive to achieve different total imbalances, the unbalanced mass not coupled with the drive shaft being taken along by the other unbalanced mass in at least one of said angular positions, and that for the angular position, in which the unbalanced masses (46,48) have the smaller angular space between them, a stop (46*a*) carried by the first driven unbalanced mass for rotation therewith taking along the second unbalanced mass (48) rotates together with the first, driven unbalanced mass (46), this stop being disposed such that the first unbalanced mass (46) is ahead of the second unbalanced mass (48).

3. Vibration machine according to claim 2, the unbalanced masses of which have different imbalance momentums, characterized in that the first unbalanced mass (46) has the greater imbalance momentum.

4. Vibration machine according to claim 2, characterized in that a stop (46*b*) taking along the first unbalanced mass (46) is provided for the angular position, in which the unbalanced masses have the greater angular distance between them.

5. Vibration machine according to claims 1 or 2, characterized in that the clutch for the third and fourth drive elements (24, 26 or 116*a*, 118*a* or 116*a*', 118*a*') has a clutch cylinder (16*b*, 18*b* or 116*b*, 118*b*) for each of said drive elements, these cylinders being disposed next to each other in axial direction and having only one single, actuatable flyweight clutch element (130 or 130') associated with them, this flyweight clutch element being secured to the drive shaft (19 or 110) such that they do not rotate relative to each other, and that for changing the clutch clutch element (130; 130') and clutch cylinders (116*b*, 118*b*; 116*b*', 118*b*') are movable relative to each other in axial direction such that the clutch element is selectively disposable inside one of the clutch cylinders associated with it.

6. Vibration machine according to claim 5, characterized in that the clutch cylinders (116*b*, 118*b*) are each secured to a drive element (116*a*, 118*a*) such that they do not rotate relative to each other, are disposed between these elements in axial direction and rotatably mounted together with these elements on the drive shaft (110).

7. Vibration machine according to claim 5, characterized in that an actuating element (120) penetrating the drive shaft (110) in axial direction is provided for the clutch element (130) displaceable along the drive shaft.

8. Vibration machine according to claim 6, characterized in that the clutch cylinders (116*b*', 118*b*') are not rotatable relative to the gear element (116*a*', 118*a*') associated with each cylinder, are displaceable in axial direction and disposable alternatively over the clutch element (130').

9. Vibration machine according to claim 8, characterized in that an actuating element (124') is rotatably mounted on the clutch cylinders (116*b*', 118*b*') and rigidly connected with these in axial direction.

10. A vibration machine for compacting materials such as earth comprising an imbalance system having first and second coaxial shafts, means mounting said shafts for independent rotary movement, a pair of unbalanced masses, first and second drive elements carried respectively by said shafts for rotation therewith, third and fourth drive elements secured respectively to said masses for rotation therewith, respective driving connections between said first and third drive elements and between said second and fourth drive elements, a drive shaft and clutch means for selectively coupling said drive shaft to said first and second drive elements, characterized in that the unbalanced masses (46, 48) are adjacent to each other in axial direction and are disposable in at least two angular positions relative to each other in accordance with the direction of drive to achieve different total imbalances, the unbalanced mass not coupled with the drive shaft being taken along by the other unbalanced mass in at least one of said angular positions, and that for the angular position, in which the unbalanced masses (46, 48) have the smaller angular space between them, a stop (46*a*) carried by the first driven unbalanced mass for rotation therewith taking along the second unbalanced mass (48), this stop being disposed such that the first unbalanced mass (46) is ahead of the second unbalanced mass (48).

* * * * *